US007548718B2

(12) United States Patent
Kubota et al.

(10) Patent No.: US 7,548,718 B2
(45) Date of Patent: Jun. 16, 2009

(54) FIXING DEVICE FOR FIXING AN UNFIXED TONER IMAGE ON A RECORDING MEDIUM AND IMAGE FORMING APPARATUS INCLUDING THE FIXING DEVICE

(75) Inventors: Keisuke Kubota, Tokyo (JP); Teruaki Mitsuya, Tokyo (JP); Takashi Suzuki, Tokyo (JP); Yoshihiro Sonohara, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 11/776,096

(22) Filed: Jul. 11, 2007

(65) Prior Publication Data

US 2008/0013995 A1 Jan. 17, 2008

(30) Foreign Application Priority Data

Jul. 12, 2006 (JP) ..... 2006-191736
Sep. 19, 2006 (JP) ..... 2006-253391

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS 6,198,888 B1 * 3/2001 Kurotaka et al. ..... 399/69
2004/0184849 A1 * 9/2004 Yonekawa ..... 399/329
2006/0127142 A1 * 6/2006 Nakamoto et al. ..... 399/329
2006/0147221 A1 * 7/2006 Asakura et al. ..... 399/69

FOREIGN PATENT DOCUMENTS

| | | |
|---|---|---|
| JP | 5-134575 | 5/1993 |
| JP | 2669731 | 7/1997 |
| JP | 2793978 | 6/1998 |
| JP | 2944282 | 6/1999 |
| JP | 2002-49257 | 2/2002 |
| JP | 2002-189364 | 7/2002 |
| JP | 2003-84597 | 3/2003 |
| JP | 2004246240 A * | 9/2004 |
| JP | 3929942 | 3/2007 |

OTHER PUBLICATIONS

Computer translation of JP2004-246240A.*
U.S. Appl. No. 11/554,343, filed Oct. 30, 2006, Keisuke Kubota, et al.

* cited by examiner

*Primary Examiner*—Quana M Grainger
(74) *Attorney, Agent, or Firm*—Oblon, Spivak, McClelland, Maier & Neustadt, P.C.

(57) ABSTRACT

A fixing device, which fixes an unfixed toner image on a recording medium, includes a heating roller, a fixing roller, a pressurizing roller, and an endless belt that stretches over the heating roller and the fixing roller. A heat source and a heat pipe are arranged in a heating roller. The heat pipe substantially uniformly heats the surface of the heating roller.

20 Claims, 5 Drawing Sheets

FIG.5A
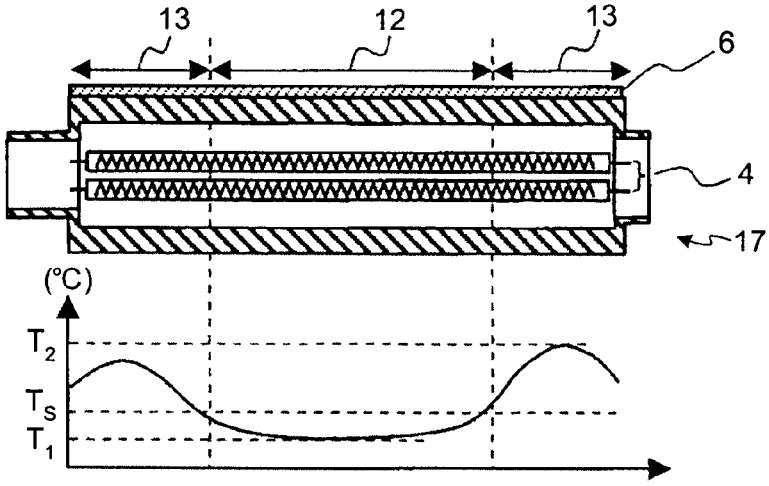
FIG.5B
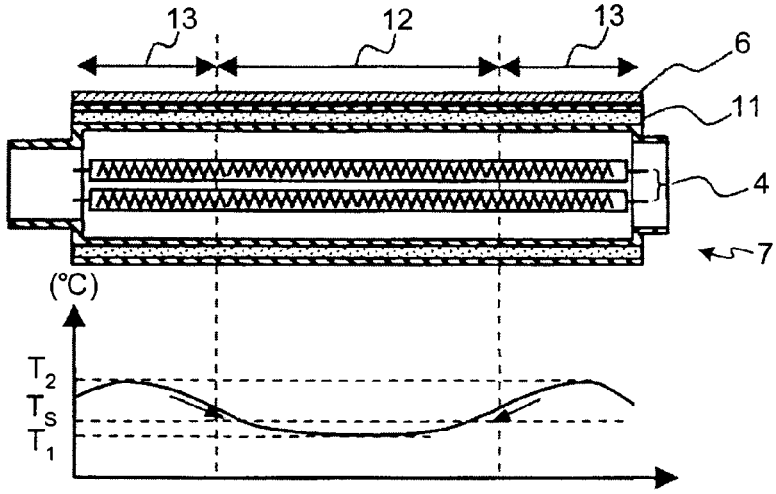
FIG.6
| | HEATING ROLLER | |
|---|---|---|
| | TYPICAL ALUMINUM CORE ROLLER | HEAT PIPE ROLLER |
| $T_S$ (CONTROL TEMPERATURE) | 175°C | 175°C |
| $T_1$ (SHEET-PATH PORTION TEMPERATURE) | 155°C | 170°C |
| $T_2$ (NO-SHEET-PATH PORTION TEMPERATURE) | 195°C | 182°C |

FIXING DEVICE FOR FIXING AN UNFIXED TONER IMAGE ON A RECORDING MEDIUM AND IMAGE FORMING APPARATUS INCLUDING THE FIXING DEVICE

CROSS-REFERENCE TO RELATED APPLICATIONS

The present application claims priority to and incorporates by reference the entire contents of Japanese priority documents, 2006-191736 filed in Japan on Jul. 12, 2006 and 2006-253391 filed in Japan on Sep. 19, 2006.

BACKGROUND OF THE INVENTION

1. Field of the Invention

The present invention relates to a fixing device that fixes an unfixed image on a recording medium, and an image forming apparatus that includes the fixing device.

2. Description of the Related Art

A fixing device is used in image forming apparatuses, such as printers, facsimiles, and copiers. A typical and widely-used fixing device includes a pressurizing roller and a fixing roller. The fixing roller includes a heater, and fixes an unfixed toner image on a paper sheet (recording medium). The fixing roller and the pressurizing roller form a nip portion in between. The temperature in the nip portion higher because of the heater present in the fixing roller. When a recording medium having an unfixed toner image thereon passes through the nip portion, the unfixed toner on the paper sheet is heated and fixed permanently to the paper sheet. Accordingly, a fixed toner image on the paper sheet is obtained. Such a fixing device includes a temperature detecting unit that is positioned at a center portion of the fixing roller in the axial direction of the fixing roller. When the recording medium passes through the nip portion, the recording medium absorbs heat of the fixing roller, therefore the temperature of the nip portion decreases. When the temperature detecting unit detects that the temperature of the nip portion has decreased, the heater is turned ON to raise the temperature of the fixing roller thereby maintaining the temperature of the nip portion to a desired temperature (hereinafter, "fixing temperature") at which an unfixed toner image is fixed on a recording medium. The heat is not lost so much at the edge portions of the fixing roller where the paper sheet does not pass over. As a result, the temperature of the edge portions gradually increases as unfixed toner images are fixed on paper sheets one after the other. This may shorten the life of the fixing roller. Furthermore, when an unfixed toner image on a wide-width paper sheet is fixed thereon immediately after unfixed toner images on paper sheets each having a width smaller than that of the wide-width sheet are continuously fixed thereon, the quality of the fixed toner image may deteriorate significantly at the edge portions of the wide-width paper sheet. Such drawbacks can be seen also in a fixing device in which one of the fixing roller and the pressurizing roller serves as a stationary member, or a fixing device in which at least one of the fixing roller and the pressurizing roller serves as a belt member. Members for fixing an unfixed toner image on a recording medium can be termed as "fixing member", and members for pressurizing the recording medium can be termed as "pressurizing member".

For better understanding, a fixing roller and a pressurizing roller are explained below as examples of the fixing member and the pressurizing member.

To deal with the above drawbacks, thermal fixing devices are proposed (for example, see Japanese Patent Application Laid-open No. H5-134575). FIG. 8 is a cross section of a typical fixing device along a width direction. The fixing device includes the fixing roller 1, and a pressurizing roller 2. FIG. 9 is a longitudinal cross section of a typical fixing roller 1. The surface of the fixing roller 1 includes a sheet-path portion 12 over which a paper sheet 5 having an unfixed toner image thereon passes, and no-sheet-path portions 13 (edge portions) over which the paper sheet 5 does not pass. The pressurizing roller 2 is pressed against the fixing roller 1 to form a nip portion through which the paper sheet 5 passes. The fixing roller 1 includes a first heating lamp 4 and a second heating lamp 4'. The heat of the first heating lamp 4 conveyed to the sheet-path portion 12 is larger than that conveyed to the no-sheet-path portions 13. Moreover, the heat of the heating lamp 4' conveyed to the no-sheet-path portions 13 is larger than that conveyed to the sheet-path portion 12. The heat flux of the heating lamps 4 and 4' (i.e., light distribution of each of heating lamps 4 and 4') is different in different portions of the fixing roller 1 such that the temperature of the no-sheet-path portions 13 does not increase. Therefore, the fixing device can deal with paper sheets having a wide width and a narrow width. In this configuration, however, the fixing device must have many heating. Moreover, many temperature sensors are required to monitor the temperature of the heating lamps. These facts disadvantageously increase the cost and the size of the device, and complicate the method of controlling the fixing temperature.

Some fixing devices have a stationary member, instead of the fixing roller, that functions as a pressurizing member and has a small frictional resistance. The same disadvantage, as that in the case of a roller, can be seen even in the case of the stationary member.

FIG. 10 is a cross section of an example of a typical fixing device including heat pipes 11. Japanese Patent No. 2793978 discloses a conventional fixing device that easily realizes substantially uniform heat distribution on the fixing roller in the axial direction of the fixing roller without increasing the size of the device. The conventional fixing device also includes cylindrical and hollow heat pipes. The heat pipes are arranged around a metal core of a fixing roller, and extend in the axial direction of the fixing roller. The heat pipes are filled with liquid. The liquid circulates in the axial direction of the fixing roller thereby producing substantially uniform heat distribution on the surface of the fixing roller. This inhibits the temperature of a "sheet-path portion" on the surface of the fixing roller from decreasing and inhibits the temperature of "no-sheet-path portions" on the surface of the fixing roller from increasing.

However, a fixing roller including heat pipes is more expensive than a typical fixing roller. For this reason, if a fixing roller or a pressurizing roller that needs to be regularly replaced includes heat pipes, the maintenance cost of the fixing device also increases. To assure the durability of the expensive fixing roller including the heat pipes, a material used for the surface of the fixing roller disadvantageously has to be selected among a few limited materials.

SUMMARY OF THE INVENTION

It is an object of the present invention to at least partially solve the problems in the conventional technology.

According to an aspect of the present invention, there is provided a fixing device that fixes an unfixed toner image on a recording medium. The fixing device includes a fixing roller; a pressurizing roller that opposes the fixing roller; a heating roller that includes a heating unit that is arranged in the heating roller and that heats the heating roller; and a heat pipe that is arranged in the heating roller and near a surface of the heating roller and that substantially uniformly heats the surface; and an endless fixing belt that stretches over the heating roller and the fixing roller and that conveys a recording medium with an unfixed toner image in a nip portion between the fixing roller and the pressurizing roller.

According to an aspect of the present invention, there is provided an image forming apparatus that includes the above fixing device.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 5A and 5B are schematic diagrams of temperature distribution on the surface of the fixing belt during the continuous fixing of toner images on paper sheets;

FIG. 6 is a table of the results of measurement of the temperatures on the surface of the fixing belt when the heating rollers configured as shown in FIGS. 5A and 5B are each used;

DETAILED DESCRIPTION OF THE PREFERRED EMBODIMENTS

Exemplary embodiments of the present invention are explained in detail below with reference to the accompanying drawings.

Figure 1:
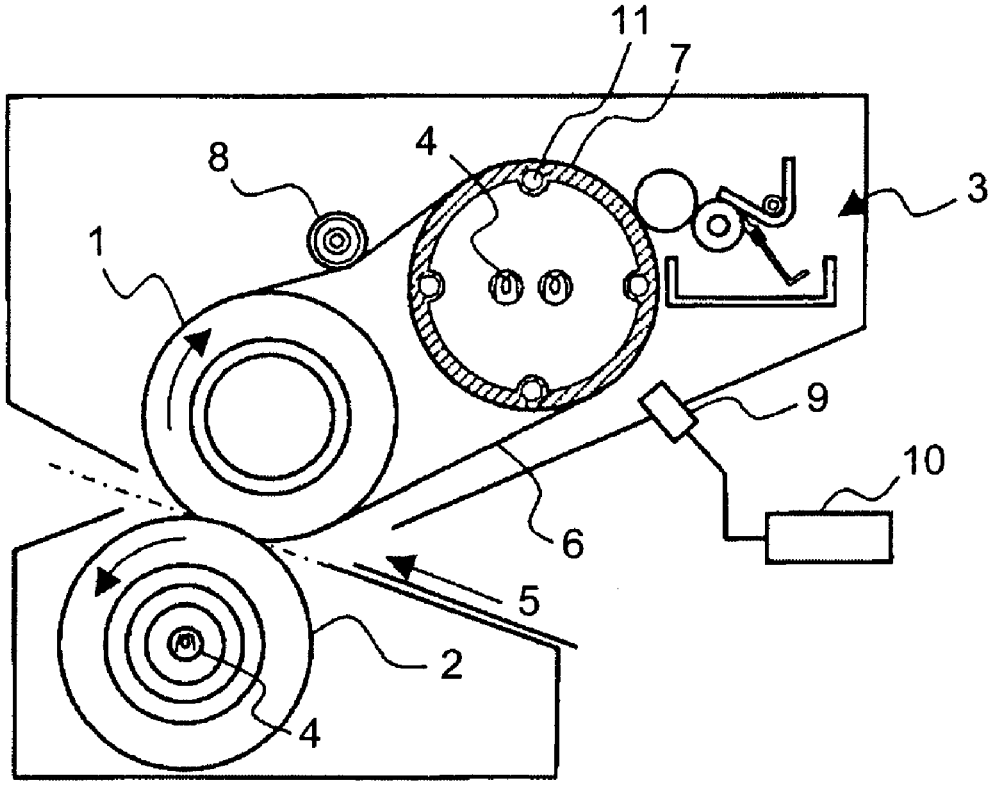
FIG. 1 is a schematic diagram of a fixing device according to an embodiment of the present invention.

FIG. 1 is a schematic diagram of a fixing device according to an embodiment of the present invention. The fixing device includes a fixing roller 1, a pressurizing roller 2, an oil applying unit 3, heating lamps 4, a fixing belt 6, a heating roller 7, a tension roller 8, a thermopile 9, a temperature detecting unit 10, and heat pipes 11.

The fixing belt 6 stretches over the fixing roller 1 and the heating roller 7. The fixing belt 6 is rotated at a speed of, for example, 450 mm/sec. The fixing belt 6 has ribs on its edges to prevent the fixing belt 6 from deviating while the fixing belt 6 is rotating. The tension roller 8 is provided outside the loop of the fixing belt 6 and it presses the fixing belt 6, thus maintaining the fixing belt 6 tensioned. The heating roller 7 heats the inner surface of the fixing belt 6. The fixing roller 1 and the fixing belt 6 can be individually or collectively referred to as "fixing member".

Figure 2:
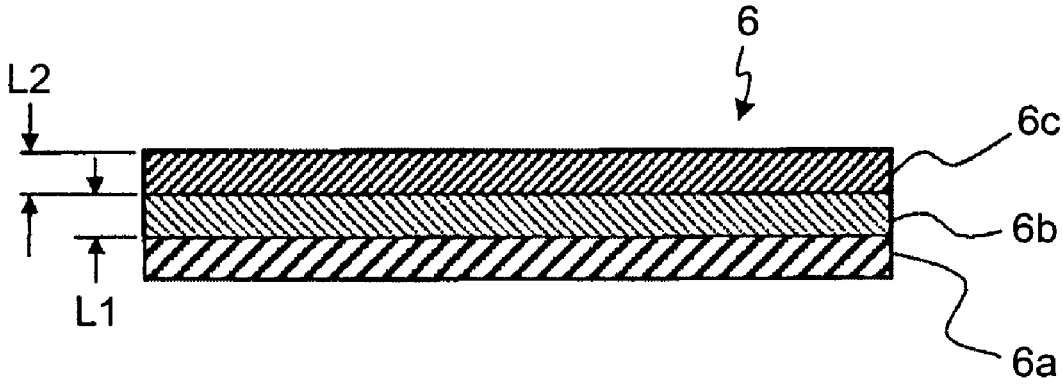
FIG. 2 is a partial enlarged cross section of a fixing belt shown in FIG. 1.

FIG. 2 is a partial enlarged cross section of the fixing belt 6. The fixing belt 6 includes a base layer 6*a*, a silicone rubber layer 6*b*, and a fluorine rubber layer 6*c*. The silicone rubber layer 6*b* is superposed on the base layer 6*a*, and the fluorine rubber layer 6*c* is superposed on the silicone rubber layer 6*b*. The silicone rubber layer 6*b* and the fluorine rubber layer 6*c* function as a heat storage layer, and are made of materials different from that of the base layer 6*a*. A heat storage layer is made of a material that has higher heat capacity and that can conduct a large amount of heat. Materials for a rubber layer are suitably used for the heat storage layer, and, for example, silicone rubber and fluorine rubber are specifically preferable. It is preferable that the rubber layer has a heat conductivity $\lambda$ (W/m·K) that satisfies the inequality $0.18 \leqq \lambda \leqq 0.3$, which is obtained based on test results. If the heat conductivity $\lambda$ is smaller than 0.18 W/m·K, heat is not sufficiently conducted to a nip portion between the fixing belt 6 and the pressurizing roller 2, and accordingly, a toner image is not properly fixed on a paper sheet 5. On the contrary, if the heat conductivity $\lambda$ is larger than 0.3 W/m·K, a large amount of the heat is released to the atmosphere while the fixing belt 6 is conveyed from the heating roller 7 to the fixing roller 1, and accordingly, the thermal efficiency decreases.

The fluorine rubber layer 6*c* that is the outermost layer directly contacts with the unfixed toner image on the paper sheet 5 to fix the toner image thereon. Thus, the paper sheet 5 needs to be released easily from the fluorine rubber layer 6*c*, i.e., sheet releasability is particularly important factor for the fluorine rubber layer 6*c*. A fluorine material is very useful as a material for the outermost layer of a fixing belt. Usually, oil is applied to the surface of the fixing belt 6 to improve the releasability of paper sheets. If the outermost layer of a fixing belt is made of fluororesin, the oil does not sufficiently spread over the surface of the outermost layer, and the desired effect of the oil cannot be obtained. On a layer made of fluorine rubber, on the contrary, the oil sufficiently spreads, and the desired effect of the oil can be obtained.

Tests on the fixing belt 6 were carried out. The test results showed that it is preferable that the silicone rubber layer 6*b* has a thickness L1 (μm) that satisfies the inequality $100 \leqq L1 \leqq 400$.

If the thickness L1 is smaller than 100 micrometers (μm), heat is not sufficiently stored in the silicone rubber layer 6*b*, and accordingly, insufficient toner-image fixing tends to occur. On the contrary, if the thickness L1 is larger than 400 μm, the thermal inertia increases too much. Accordingly, it takes time before the silicone rubber layer 6*b* starts to function for fixing a toner image on a recording medium.

Whereas, because the fluorine rubber layer 6*c* focuses on obtaining better sheet releasability, the fluorine rubber layer 6*c* functions properly even if the fluorine rubber layer 6*c* has a thickness L2 smaller than that of the silicone rubber layer 6*b*. Specifically, it is preferable that the thickness L2 (μm) satisfies the inequality $20 \leqq L2 \leqq 100$.

If the thickness L2 is smaller than 20 μm, the durability of the fluorine rubber layer 6*c* deteriorates easily. On the contrary, if the thickness L2 is larger than 100 μm, an inappropriate amount of heat is conducted.

Figure 3A:
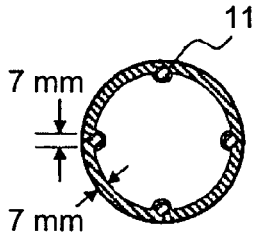
FIG. 3A is a transverse cross section of a heating roller and FIG. 3B is a longitudinal cross section of the heating roller shown in FIG. 1.
Figure 3B:
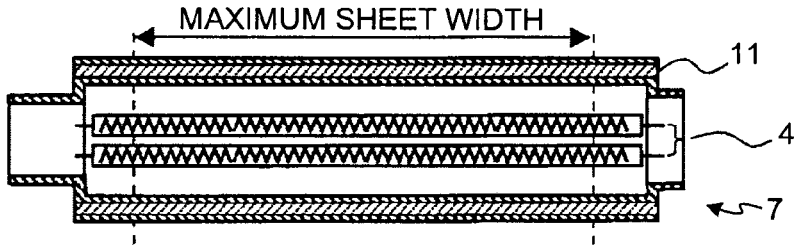

FIG. 3A is a transverse cross section and FIG. 3B is a longitudinal cross section of the heating roller 7. The two heating lamps 4 each having a length not smaller than the maximum sheet width are arranged in the heating roller 7. The heating roller 7 is hollow and cylindrical. The heating lamps 4 are halogen lamps whose total output is 2,000 watt (W). The radiant heat flux of the heating lamps 4 (light distribution of each heating lamp 4) is the same in any portion (in an axial direction) of the heating roller 7. The heating roller 7 includes the built-in heat pipes 11 made of copper and having a high thermal conductivity in the axial direction of the heating roller 7.

A method of detecting the "fixing temperature" and a method of controlling the fixing temperature of the fixing device of the embodiment is described below. The noncontact thermopile 9 opposes the heating roller 7. Between the thermopile 9 and the heating roller 7, the fixing belt 6 is positioned. Because the heat pipes 11 are built in the heating roller 7, the single thermopile 9 is enough. In the embodiment, the thermopile 9 is arranged to cover a region through which a minimum-sized paper sheet passes. To control the fixing temperature, a temperature control unit regularly samples outputs of the thermopile 9, and calculates the average of the sampled outputs. Thereafter, the temperature control unit compares the average to the sensor output corresponding to a predetermined fixing temperature Ts. Based on the result of the comparison, the heating lamps 4 are turned ON or OFF.

Figure 4:
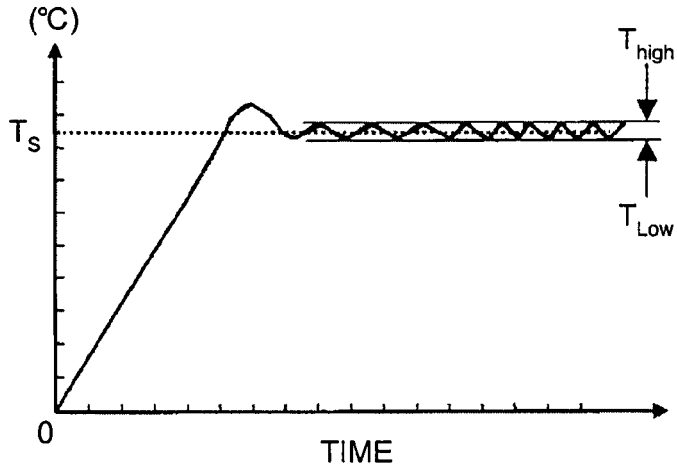
FIG. 4 is a graphical representation for explaining on/off control on heating lamps of the heating roller shown in FIG. 1.

FIG. 4 is a graphical representation for explaining on/off control on the heating lamps 4.

Based on the outputs of the thermopile 9, an ON temperature $T_{LOW}$, at which the heating lamps 4 should be turned ON, and an OFF temperature $T_{HIGH}$, at which the heating lamps 4 should be turned OFF, are previously set. Once the temperature of the surface of the fixing belt 6 falls below the ON temperature $T_{LOW}$, the heating lamps 4 are turned ON. Once the temperature of the surface of the fixing belt 6 rises above the OFF temperature $T_{HIGH}$, on the other hand, the heating lamps 4 are turned OFF.

The fixing roller 1 is pressed against the pressurizing roller 2 that opposes the fixing roller 1, so that a nip portion is formed. The paper sheet 5 is conveyed while the unfixed toner image thereon is fixed at the nip portion. The fixing roller 1 is a cylindrical roller including a metal pipe made of SUS and a 15-millimeter thick silicone rubber layer provided on the surface of the metal pipe. The pressurizing roller 2 is a cylindrical roller that includes a 2-millimeter thick silicone rubber and a 50-μm thick conductive PFA tube that covers the surface of the silicone rubber. The pressurizing roller 2 includes the heating lamp 4 arranged therein. The heating lamp is turned ON when an image forming apparatus is turned ON and/or when the fixing device restarts the operation after a long stand-by state. Accordingly, the warming-up time can be shortened. The fixing device includes the oil applying unit 3 that evenly applies fixing oil onto the surface of the fixing belt 6 that comes into contact with a toner image. Whereby, offset is prevented from occurring. The configuration of the fixing device is not limited to that explained above. For example, the fixing device can include a belt for conveying the paper sheet 5 that is stretched over the pressurizing roller 2. Such a fixing device can convey the paper sheet 5 easily, and basically functions in the same manner as the fixing device of the embodiment.

The flow of the sheet paper 5 and the temperature distribution on the surface of the fixing belt 6 after the paper sheet 5 passes the fixing belt 6 is explained below.

The paper sheet 5 is conveyed in the direction indicated by the arrow shown in FIG. 1, and the unfixed toner image on the paper sheet 5 is fixed by heat and pressure. In the fixing device, the heating lamps 4 in the heating roller 7 are turned ON, and the temperature detecting unit 10 maintains, by using the thermopile 9, the temperature of the surface of the fixing belt 6 at 175° C. Once the paper sheet 5 is conveyed to the nip portion, the toner on the paper sheet 5 melts and is fixed on the paper sheet 5. Heat is lost in melting the toner whereby the temperature decreases at the portion of the surface of the fixing belt 6 corresponding to the width of the paper sheet 5. However, the heat pipes 11 realize substantially uniform temperature distribution on the surface of the heating roller 7 in the axial direction of the heating roller 7. As explained above, in the embodiment, the heat pipes are provided in the roller with the heat source built in, so that an excessive temperature difference is not caused on the surface of the heating roller 7, which inhibits unnecessary energy consumption.

FIGS. 5A and 5B are schematic diagrams of temperature distribution on the surface of the fixing belt 6 on the heating roller, during the continuous fixing of toner images on paper sheets. FIG. 5A represents the case where a conventional heating roller 17 including an aluminum core is used. FIG. 5B represents the case where the heating roller 7 including the built-in heat pipes 11 is used. The surface of the fixing belt 6 includes a sheet-path portion 12 through which the paper sheet 5 passes, and no-sheet-path portions 13 through which the paper sheet 5 does not pass.

The graphs shown in FIGS. 5A and 5B represent the temperature distribution on the surface of the fixing belts 6 obtained while 200 sheets of A4-size paper pass through the fixing belt 6.

FIG. 6 is a table of the results of measuring the temperatures of the sheet-path portion 12 and the no-sheet-path portions 13 on the surface of each of the fixing belts 6 for the heating rollers 17 and 7. The fixing control temperature $T_s$ is previously set as 175° C. $T_1$ denotes the lowest temperature of the sheet-path portion 12 and $T_2$ denotes the highest temperature of the no-sheet-path portions 13 during the continuous printing of paper sheets.

In the case of the heating roller 17, the temperature $T_1$ was 155° C. Meanwhile, the temperature $T_2$ was increased by the heating lamps 4 to 195° C. For this reason, when an A-3 size paper sheet, which is larger than the A-4 sized sheet, was conveyed immediately after the temperature of the no-sheet-path portions 13 increased, the toner image was not properly fixed at the sheet-path portion 12 due to insufficient temperature of the sheet-path portion 12, and hot offset occurred at the no-sheet-path portions 13. On the other hand, in the case of the heating roller 7, the temperature $T_1$ was 170° C. and the temperature $T_2$ was 182° C. This realized a relatively uniform temperature distribution on the surface of the fixing belt 6 compared to that on the heating roller 17; moreover, the temperature variation is small. The heat pipes 11 inhibits the temperature increase on the no-sheet-path portions 13, but on the contrary, increases the temperature of the sheet-path portion 12 to compensate the lost temperature of the sheet-path portion 12.

The heat pipes 11 transfer the heat in the axial direction of the heating roller 7, realizing substantially uniform temperature distribution. The heat pipes 11 are, for example, four in number, and they are arranged at the same intervals in the circumferential direction of the heating roller 7 of 80 mm. Each of the heat pipes 11 has a diameter of 7 millimeters (mm) and a length longer than the maximum sheet width in the axial direction of the heat pipes 11. The thickness of the aluminum of the heating roller 7 is 7 mm. The properties of the heating roller 7 and the heat pipes 11 are optimum ones based on the measurement results. The optimum properties change depending on the material and diameter of the heating roller 7, the rotation speed of the fixing belt 6, the wattage W of the heating lamps 4, and the like.

In the embodiment, the base layer 6*a* of the fixing belt 6 shown in FIG. 2 is made of polyimide resin and has a thickness of 90 μm, the silicone rubber layer 6*b* has a thickness L1 of 200 μm, and the fluorine rubber layer 6*c* has a thickness L2 of 50 μm. By applying the above thicknesses to the fixing belt 6 used in the temperature measurement, the temperature distribution corresponding to the results represented in FIG. 6 was obtained. The thickness of the fixing belt 6 and the thermal conductivity of the material of the fixing belt 6 are changed depending on the belt rotation speed and the wattage W of the heating lamps 4 as in the case of the properties of the heat pipes 11.

Optimizing the heat pipes 11 and the fixing belt 6 results in stable temperature distribution on the surface of the fixing belt 6 in the direction along the width of the paper sheet 5. Thus, it is possible to provide the fixing device which is able to maintain stable image quality. The heat pipes 11 are arranged not in the fixing roller 1 or the pressurizing roller 2 that requires regular replacement but in the heating roller 7. Therefore, even if the fixing roller 1 and the pressurizing roller 2 are regularly replaced in the conventional manner, the maintenance cost of the fixing device is not increased. Compared to the fixing device that includes the fixing roller 1 including the heat pipes 11, the fixing device of the embodiment requires low maintenance costs.

Figure 7:
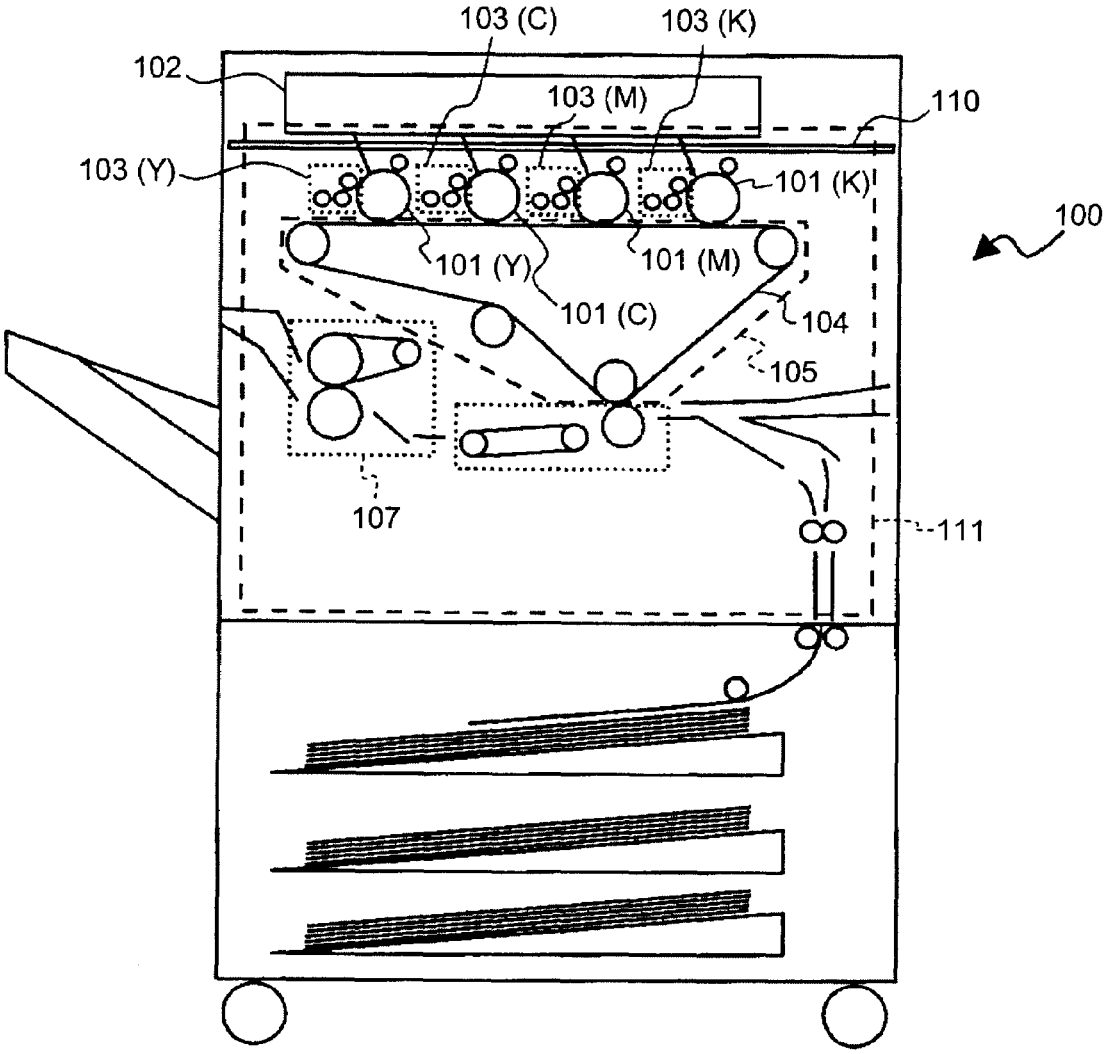
FIG. 7 is a schematic diagram of an image forming apparatus according to another embodiment.
Figure 8:
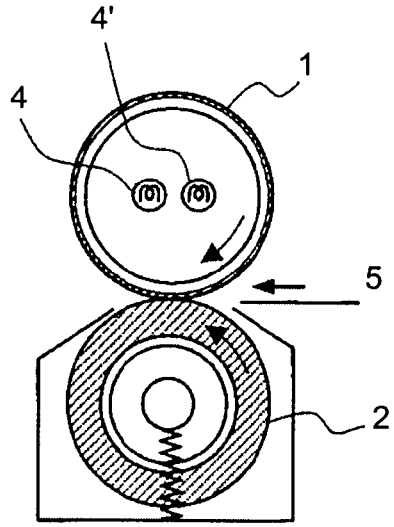
FIG. 8 is a cross section of a typical fixing device.
Figure 9:
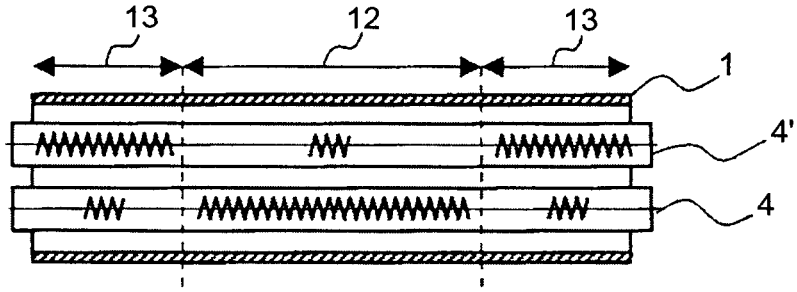
FIG. 9 is a longitudinal cross section of a fixing roller shown in FIG. 8.
Figure 10:
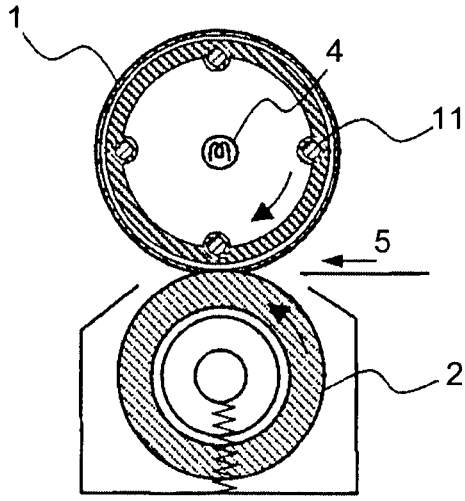
FIG. 10 is a cross section of a typical fixing device that includes a fixing roller including heat pipes.

FIG. 7 is a schematic diagram of an image forming apparatus 100 according to another embodiment of the present invention. The image forming apparatus 100 includes the fixing device according to the above embodiment. The image forming apparatus 100 includes image bearing media 101(C) (cyan), 101(M) (magenta), 101(Y) (yellow), and 101(K) (black); an optical scanning device 102; developing devices 103(C), 103(M), 103(Y), and 103(K); a transfer belt 104; an intermediate transfer device 105; a fixing device 107; an optical-scanning device supporting frame 110; and a side plate 111. The optical scanning device 102 exposes the four image bearing media 101 with light beams based on the image information to form four electrostatic latent images simultaneously. An image forming apparatus is known as well, which includes, as the exposure device, an LED array including LEDs arranged in the longitudinal direction of each of the four image bearing media 101(C), 101(M), 101(Y), and 101(K).

Four driving units are arranged for driving the four image bearing media 101(C), 101(M), 101(Y), and 101(K), respectively, and four driving units are arranged for driving the respective four developing devices 103(C), 103(M), 103(Y), and 103(K) that correspond to the image bearing media 101(C), 101(M), 101(Y), and 101(K), respectively. The electrostatic latent images formed by the optical scanning device 102 are developed and visualized by the developing devices 103(C), 103(M), 103(Y), and 103(K).

The optical scanning device 102 is arranged above the four image bearing media 101(C), 101(M), 101(Y), and 101(K), and is fixed to the optical-scanning device supporting frame 110.

The optical-scanning device supporting frame 110 is positioned by and fixed to the platy side plate 111. The positional relationship between the optical-scanning device supporting frame 110 and the image bearing media 101(C), 101(M), 101(Y), and 101(K) is also determined by the side plate 111. After the developing devices 103(C), 103(M), 103(Y), and 103(K) obtain four toner images on the four image bearing media 101(C), 101(M), 101(Y), and 101(K), the toner images are sequentially transferred to an intermediate transfer medium on an endless belt. The superposed toner image on the intermediate transfer medium is transferred to a paper sheet P so that a full color image formed of the four colors is obtained. The fixing device 107 fixes the full color image on the paper sheet P, and the paper sheet P with the full image permanently fixed thereon is discharged. By using the fixing device according to the embodiment as the fixing device 107 of the image forming apparatus 100, it is possible to provide a small-sized image forming apparatus at low cost that has a simple configuration and assures stable image quality of a fixed image on a recording medium.

The image forming apparatus shown in FIG. 7 employs the intermediate transfer method in which toner images are transferred from the image bearing media to a recording medium via a transfer medium. The image forming apparatus, however, can be the one that employs the direct transfer method in which toner images are directly transferred to a recording medium.

According to an aspect of the present invention, the maintenance cost of a fixing device can be kept lower.

According to another aspect of the present invention, stable image quality can be assured for a large number of fixed toner images, and an image forming apparatus that requires lower maintenance cost can be provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device that fixes an unfixed toner image on a recording medium, the fixing device comprising:

a fixing roller;

a pressurizing roller that opposes the fixing roller;

a heating roller, the heating roller including:

a heating unit arranged in the heating roller to heat the heating roller; and at least one heat pipe is arranged in the heating roller and adjacent to a surface of the heating roller and that substantially uniformly heats the surface; and an endless fixing belt that stretches over the heating roller and the fixing roller and that conveys a recording medium with an unfixed toner image in a nip portion between the fixing roller and the pressurizing roller.

2. The fixing device according to claim 1, wherein the heating unit extends in the longitudinal direction of the heating roller, is arranged parallel to a rotation axis of the heating roller, and has a uniform radiant flux along the rotation axis substantially covering both a primary and a secondary surface of the heating roller corresponding to a sheet path portion and a non-sheet path portion of the fixing belt.

3. The fixing device according to claim 1, further comprising a temperature detecting unit that detects a temperature of the endless fixing belt stretched over the heating roller, wherein the heating unit controls heating of the heating roller based on the temperature detected by the temperature detecting unit.

4. The fixing device according to claim 1, wherein the fixing belt includes a base layer and a rubber layer that serves as a heat storage layer and that is made of a material different from a material of the base layer, the rubber layer having a large heat capacity and conducting a large amount of heat.

5. The fixing device according to claim 4, wherein the rubber layer has a thermal conductivity $\lambda$ (W/mK) that satisfies $0.18 \leqq \lambda \leqq 0.3$.

6. The fixing device according to claim 4, wherein the rubber layer is made of silicone rubber and at least one of the heat pipes is made of copper.

7. The fixing device according to claim 6, wherein the rubber layer has a thickness L1 (μm) that satisfies $100 \leqq L1 \leqq 400$.

8. The fixing device according to claim 4, wherein the rubber layer includes a first layer and a second layer, the first layer being laid on the base layer and being made of silicone rubber, and the second layer being laid on the first layer and being made of fluorine rubber.

9. The fixing device according to claim 8, wherein the second layer has a thickness L2 (μm) that satisfies $20 \leqq L2 \leqq 100$.

10. The fixing device according to claim 9, wherein the first layer has a thickness L1 (μm) that satisfies $100 \leqq L1 \leqq 400$.

11. An image forming apparatus that includes a fixing device that fixes an unfixed toner image on a recording medium, the fixing device comprising:

a fixing roller;

a pressurizing roller that opposes the fixing roller;

a heating roller, the heating roller including:

a heating unit arranged in the heating roller to heat the heating roller; and at least one heat pipe is arranged in the heating roller and adjacent to a surface of the heating roller and that substantially uniformly heats the surface; and an endless fixing belt that stretches over the heating roller and the fixing roller and that conveys a recording medium with an unfixed toner image in a nip portion between the fixing roller and the pressurizing roller.

12. The image forming apparatus according to claim 11, wherein the heating unit extends in the longitudinal direction of the heating roller, is arranged parallel to a rotation axis of the heating roller, and has a uniform radiant flux along the rotation axis substantially covering both a primary and a secondary surface of the heating roller corresponding to a sheet path portion and a non-sheet-path portion of the fixing belt.

13. The image forming apparatus according to claim 11, further comprising a temperature detecting unit that detects a temperature of the endless fixing belt stretched over the heating roller, wherein the heating unit controls heating of the heating roller based on the temperature detected by the temperature detecting unit.

14. The image forming apparatus according to claim 11, wherein the fixing belt includes a base layer and a rubber layer that serves as a heat storage layer and that is made of a material different from a material of the base layer, the rubber layer having a large heat capacity and conducting a large amount of heat.

15. The image forming apparatus according to claim 14, wherein the rubber layer has a thermal conductivity λ (W/mK) that satisfies $0.18 \leqq \lambda \leqq 0.3$.

16. The fixing device according to claim 14, wherein the rubber layer is made of silicone rubber and at least one of the heat pipes is made of copper.

17. The image forming apparatus according to claim 16, wherein the rubber layer has a thickness L1 (μm) that satisfies $100 \leqq L1 \leqq 400$.

18. The image forming apparatus according to claim 14, wherein the rubber layer includes a first layer and a second layer, the first layer being laid on the base layer and being made of silicone rubber, and the second layer being laid on the first layer and being made of fluorine rubber.

19. The image forming apparatus according to claim 18, wherein the second layer has a thickness L2 (μm) that satisfies $20 \leqq L2 \leqq 100$.

20. The image forming apparatus according to claim 19, wherein the first layer has a thickness L1 (μm) that satisfies $100 \leqq L1 \leqq 400$.

* * * * *